US010717505B2

(12) United States Patent
Richmond et al.

(10) Patent No.: US 10,717,505 B2
(45) Date of Patent: Jul. 21, 2020

(54) SYSTEM AND METHOD TO REMOVE MOISTURE FROM BOATS

(71) Applicants: Scott Richmond, Grand Rapids, MI (US); Jon Bartnick, Wyoming, MI (US)

(72) Inventors: Scott Richmond, Grand Rapids, MI (US); Jon Bartnick, Wyoming, MI (US)

( * ) Notice: Subject to any disclaimer, the term of this patent is extended or adjusted under 35 U.S.C. 154(b) by 430 days.

(21) Appl. No.: 15/253,635

(22) Filed: Aug. 31, 2016

(65) Prior Publication Data

US 2017/0166284 A1 Jun. 15, 2017

Related U.S. Application Data

(63) Continuation-in-part of application No. 12/830,336, filed on Jul. 4, 2010, now Pat. No. 9,945,612, which is a continuation-in-part of application No. 11/686,129, filed on Jul. 3, 2007.

(51) Int. Cl.

| | |
|---|---|
| ***F26B 21/00*** | (2006.01) |
| ***B63B 71/00*** | (2020.01) |
| ***F26B 21/08*** | (2006.01) |
| *B27K 3/15* | (2006.01) |
| *B63B 81/00* | (2020.01) |

(52) U.S. Cl.

CPC ..... *B63B 71/00* (2020.01); *F26B 21/001* (2013.01); *F26B 21/006* (2013.01); *F26B 21/083* (2013.01); *B27K 3/153* (2013.01); *B63B 81/00* (2020.01); *F26B 2210/16* (2013.01)

(58) Field of Classification Search

CPC ..... F26B 21/02; F26B 21/06; F26B 21/08; F26B 21/086; F26B 21/10; F26B 25/06; F26B 25/14; F26B 25/18; F26B 25/22; F26B 13/00; F26B 2210/16; B63B 13/02; B63B 2009/008; B63B 9/00

USPC ..... 34/443, 467, 468, 471, 474, 475, 476, 34/477, 493, 494, 495, 497, 507, 195, 34/196, 437, 413

See application file for complete search history.

(56) References Cited

U.S. PATENT DOCUMENTS 2,768,485 A * 10/1956 Clarke ..... B24B 3/247 451/276
3,235,206 A * 2/1966 Luketa ..... A01K 73/06 248/188.2
4,872,270 A * 10/1989 Fronheiser ..... F26B 3/00 34/421
5,155,924 A * 10/1992 Smith ..... E04B 1/7092 15/405

(Continued)

OTHER PUBLICATIONS www.rotdoctor.com/glass/glrotrepair.html, Rot Repair in Fiberglass boats, Oct. 28, 2005, rotdoctor.com.*

*Primary Examiner* — John P McCormack
(74) *Attorney, Agent, or Firm* — Foster Swift Collins & Smtih PC; Zachary W. Behler

(57) ABSTRACT

A system and process is provided to deplete or remove moisture from wood coring in boats by piercing 20 a fiberglass outer skin; forming 30 bores or holes 200 in wood coring to form an exposed portion; processing ambient air 35 to create processed air; pumping or displacing 40 processed air into the bores or holes 200; penetrating 50 an exposed portion 80; with a sealant 100; and filling 60 the exposed portion 80 with a sealant 100.

13 Claims, 8 Drawing Sheets

(56) References Cited

U.S. PATENT DOCUMENTS

| | | | | |
|---|---|---|---|---|
| 6,457,258 | B1 * | 10/2002 | Cressy | E04B 1/7015 34/218 |
| 6,886,271 | B2 | 5/2005 | Storrer | |
| 2001/0049883 | A1 * | 12/2001 | Ryden | D06F 59/02 34/104 |
| 2005/0271800 | A1 * | 12/2005 | DeTurris | B29C 73/02 427/140 |
| 2015/0340760 | A1 * | 11/2015 | Booth | H01Q 1/1207 248/514 |

* cited by examiner

SYSTEM AND METHOD TO REMOVE MOISTURE FROM BOATS

RELATED APPLICATIONS

This is a continuation in part application, and claims priority from application Ser. No. 12/830,336 filed Jul. 4, 2010, which is still pending at the time of the filing of this CIP application.

BACKGROUND OF THE INVENTION

This invention relates to a system and method of drying wood structures, particularly those found in boats.

Boats may be comprised of wood coring in certain areas. The coring may be stringers, transoms, and bulkheads, and the back of the boat. Coring provides hull strength. The present invention may also be used on decks of a boat or house, and other wood. Wood coring can weigh less than fiberglass coring. Wood coring is usually coated with fiberglass, to form a fiberglass outer skin. However, moisture can still enter the wood coring. When moisture enters the wood coring it can weaken the structural integrity of the wood coring. In some cases, the wood coring becomes saturated, partially saturated, or moldy. The boat may then become too weak to operate safely in the water; or it may be a source of toxic mold or cause of other respiratory problems. Further, the boat may be un-insurable when moisture enters the coring. Thus the coring may have to be cut, or removed and then rebuilt. Generally, by use of a moisture meter, if the reading is over 15%, then repairs are necessary.

U.S. Pat. No. 6,886,271 ("the '271 patent" or "the Storrer patent") discloses a system to remove water and moisture from hard wood flooring. This patent does not disclose hole creation or the drilling of holes to expose wood, and to remove moisture therefrom.

The process of the present invention is less destructive than the prior art. For example, U.S. Patent Publication No. 2005/0271800 ("the DeTurris application") removes coring by vacuuming, which causes distortion in the wood coring. The applicants' process may leave a ½ inch diameter hole that can easily be filled and finished.

DeTurris removes coring, whereas applicant's invention does not remove coring. DeTurris uses a vacuum to pull air out, whereas applicant forces processed air in. During the vacuum process, it is possible that the wood can be deformed slightly, and with a fiberglass exterior, the interior deformation is highly visible when looking at the fiberglass exterior. Also, using a vacuum process pulls air to affected area, which can draw in unwanted debris. Moreover, DeTurris requires the removal of a large piece of laminate to the repaired area. DeTurris at [0047] states "Obviously, all removed items must be replaced after the repair. If the de-coring is performed from the exterior of the hull, access is more easy.

The applicant's invention does not de-core and does not remove items.

DeTurris and Storer use ambient air as opposed to processing the air first, which is referred to herein as processed air.

U.S. Pat. No. 6,457,258 to Cressy et al. discloses two large hoses that are disposed in a room, and warm air is blown into the room.

The process of the prior art also tends to void the warranty of the boat due to the substantial structural changes.

Wet areas of the boat inside the hull or inside the exterior structure or coating can be caused by water coming in from vents, swim platforms, or near anything that is connected to the exterior structure of the boat. The moisture may be in the transoms, stringers, and coring.

To repair a boat that has too much moisture inside the exterior structure may take 3-4 months, and cost $20,000.00 to $75,000.00. This type of repair is usually referred to as repair and replace. The exterior sides of a boat are usually comprised of a gelcoat. This type of repair makes the boat un-insurable in many cases.

As can be seen, there is a need for a system and method that removes moisture from wood coring. There is also a need for a system and method that does not require the removal and reconstruction of coring. There is also a need for a system and method to remove moisture from coring at a reduced cost, and with less down time of the boat. There is also a need for a system and method to apply a sealant, epoxy, or protectant that penetrates the wood; and to apply a sealant, epoxy, or protectant to fill holes in wood coring. There is also a need to remove moisture from wood coring without voiding the warranty of the manufacturer. There is also a need to use air that is processed to remove moisture, and then use this "processed air."

There is a need for a system and method to remove moisture from wood using a hose or member that enters from the bottom of the boat.

There is a need for a system and method to drill up from the lower side of the boat substantially parallel to the side of the boat, an optimum angle.

There is a need to dry a transom without removing the engine.

There is a need to remove moisture from a boat with only 2 weeks of downtime and for a cost of about $7000.00.

The applicants' process is currently used by one of the largest boat manufacturer's in the world for a number of reasons:

1. The present invention process is able to dry coring faster than the prior art. This is possible because the applicants' process dries the air used in drying the coring. The process of the present invention uses a desiccant to reduce the moisture in the processed air by about 60% to about 70%. The percentages are averages obtained on site;

2. The applicants' process is simply less destructive than the prior art. For example, using the applicants' process, the worst case scenario is a number of ½" holes and in most cases on the exterior of boats, the holes are ¼". When the prior art process or apparatus, such as that disclosed in DeTurris is used, this vacuum process requires holes having a diameter of about 1 inch up to about and can go to 2½ inches. To repair a hole that is greater than 1 inch in diameter requires structural repair. Whereas a hole smaller than 1 inch, such the applicants process that only requires ¼ inch diameter holes, only requires cosmetic repair. Therefore, after using the applicants' process, one only needs to dry and perform cosmetic repairs. However, using the process of the prior art, requires drying and performing structural repairs.

SUMMARY OF THE INVENTION

One aspect of the present invention is a method of removing moisture from wood coring of a boat, comprising the steps of: piercing 20 a fiberglass outer skin; forming 30 a bore or exposed portion 200 in wood coring to form an exposed portion; processing ambient air 35 to create processed air; and pumping or displacing 40 said processed air into said exposed portion 200.

Another aspect of the present invention is a method to remove moisture from at least one of either wood or foam from a boat, comprising: measuring the angle of the side of the boat; positioning a drill fixture under the side of the boat at a pre-determined angle based on the angle of the side of the boat; drilling upwardly into the side of the boat at the appropriate angel to create an exposed portion; displacing 40 processed air into the exposed portion 200; and filling 60 the exposed portion with a sealant 100.

These and other features, aspects and advantages of the present invention will become better understood with reference to the following drawings, description and claims.

DETAILED DESCRIPTION OF THE INVENTION

REFERENCE NUMERALS

Figure 1:
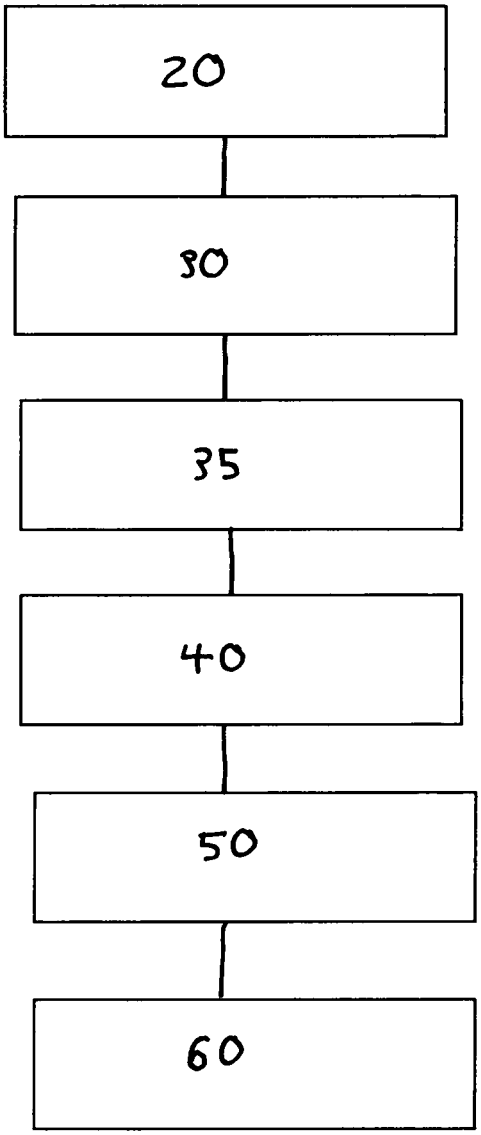
FIG. 1 illustrates a schematic of an embodiment of a moisture removal system of the present invention.

10 moisture removal system
15 boat
20 piercing
30 forming
35 processing ambient air
40 pumping or displacing
50 penetrating
60 filling
70 spacing
80 exposed portion
90 ultra-dry air
100 sealant
110 capturing the ultra-dry air
120 hose
130 hose aperture
140 longitudinal hole
200 bores or holes or exposed portion
210 stringer
300 inlet end
320 outlet end
330 measure angle
340 positioning fixture adjacent to boat
350 positioning a hose into the bore
400 external source
500 drill fixture
510 fixture base
520 drill aperture
530 drill
540 drill bit
550 rounded corner
560 drill bit angle
570 wheel
580 carriage
590 carriage direction of travel
600 side
610 processed air
620 drilling upwardly
630 displacing processed air into the exposed portion
640 exposed portion
650 inserting a hose with hose apertures and a longitudinal aperture into the exposed portion The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention may be used for removing moisture from wood by using processed air 610, not ambient air. Moisture includes liquid and water. The present invention is of particular importance for use to remove moisture from the coring of boats. In one embodiment the processed air 610 has a relative humidity of about 2-4% and is about 120 degrees Fahrenheit.

The present invention differs from the prior art by, among other things, the use of a method that removes moisture but does not require destruction and reconstruction of the coring. The present invention also differs by not using ambient air, but processed air. Processed air 610 is air in which moisture is removed. This document refers to air in which moisture is removed as "processed air" or "ultra-dry air."

The present invention allows the structural integrity of the coring to remain, which (1) reduces the cost involved in removing the coring and reconstructing new coring; (2) reduces the time in which the boat 15 is unavailable for use because of the time involved to remove and reconstruct coring.

FIG. 1 is a general schematic that illustrates an embodiment of a moisture removal system 10 of the present invention, including steps that may include:

1. piercing 20 a fiberglass outer skin;
2. forming 30 bores or holes 200 in wood coring to form an exposed portion;
3. processing ambient air 35 to create processed air 610
4. pumping or displacing 40 processed air 610 into the bores or holes 200;
5. penetrating 50 an exposed portion 80; with a sealant 100; and
6. filling 60 the exposed portion 80 with a sealant 100.

The piercing 20 may be used with a drill 530. The piercing 20 causes a hole or bore 200 in the boat. The hole or bore 200 in the boat may be 3/16 of an inch in diameter, or about ½ inch in diameter.

In one exemplary embodiment of the present invention, the piercing step 20 includes the forming 30 of bores or holes 200 that are spaced apart by a distance of about 8 inches. In one exemplary embodiment of the present invention, the holes 200 may have a diameter of about ½ of an inch. In one exemplary embodiment of the present invention, the holes 200 may have a diameter of about ¼ of an inch. The processing of ambient air 35 may include removing at least 50% or at least about 50% of the moisture from ambient air. The processing step 35 may employ the use of a desiccant to convert ambient air into processed air 610 or ultra-dry air. The pumping or displacing 40 of dry air into the holes 200 may be performed by injection hoses that are adapted to fit the holes 200.

The holes 200 with the larger diameter, i.e. about ½ of an inch, may be used to receive injection hoses with a larger diameter; to displace or pump 40 more dry air that the injection hoses having a smaller diameter, such as about ¼ of an inch. In one exemplary embodiment, the forming 30 of bores or holes 200 can be created by drilling the bores or holes 200. In one exemplary embodiment, the spacing 70 of the bores or holes 200 may be greater than 8 inches. In one exemplary embodiment, the spacing 70 of the bores or holes 200 may be less than 8 inches. In one exemplary embodiment, the spacing 70 of the bores or holes 200 may vary. The forming 30 of bores or holes 200 creates an exposed portion 80 of the coring. In one exemplary embodiment the holes 200 are about 95% of the length of the wood in which the hole 200 may be in. For example, if a hole 200 is formed in a stringer, and the stringer is 100 inches long, the hole 200 may be 95 inches long. In one exemplary embodiment of the present invention, the dry air may be displaced or pumped 40 through the holes 200 at a rate of about 100 cubic feet per minute. Sometimes, it may take up to about 9 days to dry the coring, with use of the present invention.

The pumping step 40 may be performed by pumping in processed air 610 or ultra-dry air 610 from an inlet end 300 of the bore 200, so that the ultra dry air is displaced adjacent to the exposed portion 80, to remove moisture from the coring.

In one exemplary embodiment the pumping of air step 40 may include the processing of ambient air step 35. In this embodiment the pumping step 40 may be performed in two stages, first the ambient air may be processed 35 at the time in which it may be pumped in by using a first pumping step 42. The first pumping step 42 may include the use of an air dryer. In one exemplary embodiment, the air dryer may be a Dri-Force desiccant.

This first step 42 may be followed by a second step 44. In one exemplary embodiment the second pumping step 44 may include the use of a mid pressure, high volume pump. The first pumping step 42 may be used to dry the air in and around the exposed portion 80. The second pumping step 44 may be used to pump air into the exposed portion 80. In one exemplary embodiment, the first pumping step 42 may be used to dry the air to create and ultra dry air 90. The second pumping step 44 may include capturing 110 the ultra dry air 90, and then displacing the ultra dry air 90 into the exposed portion 80. In one embodiment the air is pumped at about 100 cubic feet per minute. However more than one system or pump can be used. In one embodiment the pump may be running for about 6-9 days.

In one exemplary embodiment, the penetrating step 50 may include penetrating the exposed portion 80 with a first sealant 100 or epoxy or a penetrating epoxy. The filling step 60 may include the filling 60 of the exposed portion 80 with a second sealant 100' or epoxy.

Figure 2:
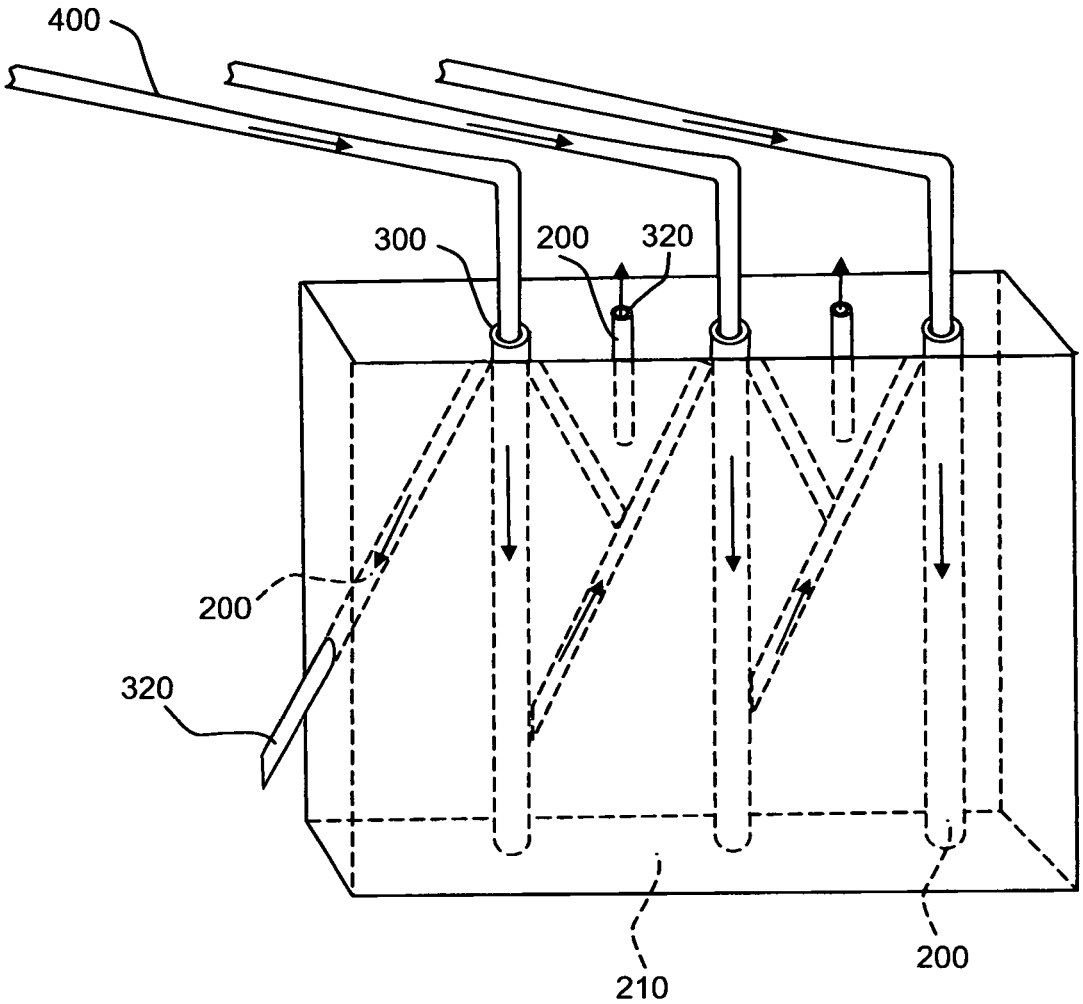
FIG. 2 illustrates a schematic of an exemplary method of use of the present invention.

FIG. 2 illustrates one method of using the system, including the forming 30 of a plurality of bores 200 within a stringer 210. The bores 200 are capable of having an inlet end 300, and an outlet end 320. The inlet end 300 may receive air from an external source 400, such as an air pump. The outlet end 320 enables an escape or exit route for the air pumped in through the inlet end 300. As the air is displaced throughout the bores 200 adjacent the exposed portion 80, and out of the outlet end 320; the moisture is removed.

After moisture is removed, then the bores 200 can be filled with a sealant 100 or an epoxy in a filling step 60. For example, a first sealant 100 or epoxy may be used to penetrate the exposed portion 80. And a second sealant 100' or epoxy may be used to fill the bores 200.

Figure 3:
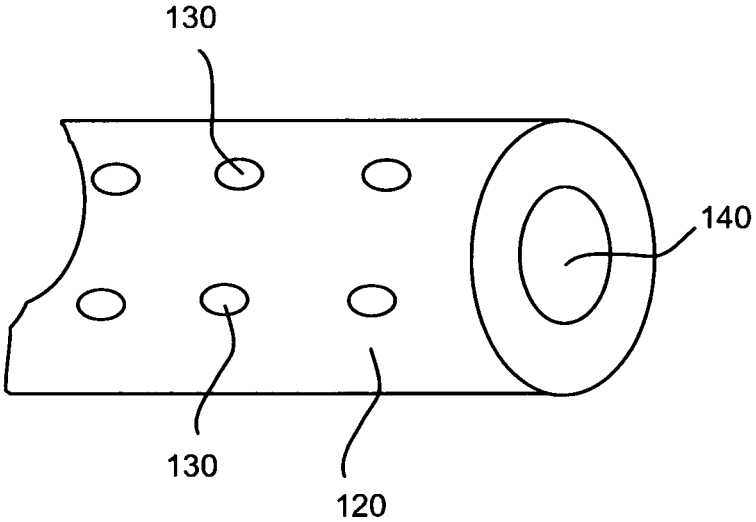
FIG. 3 illustrates an embodiment of a hose used in the system and method.
Figure 6:
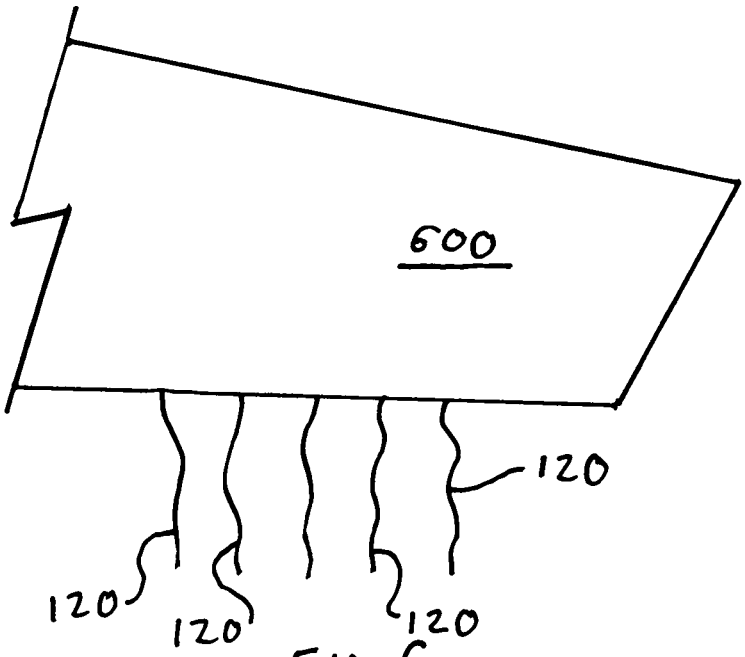
FIG. 6 illustrates an embodiment with the hoses shown disposed in holes extending upwardly from the bottom side 600 of the boat.

FIG. 3 illustrates a hose 130 having hole apertures 120 disposed in the surface to force air out sideways, and a longitudinal hole 140 at the hose termination. This part of the hose 130 is inserted in the side of the boat from bottom side 600. After the hose 120 is inserted from the bottom side 600, then the processed air 610 is displaced through the hose 120 and out the hose aperture 130 and longitudinal hold 140. The hoses 120 are illustrated being disposed in the sides from the bottom side 600 in FIG. 6.

Figure 4:
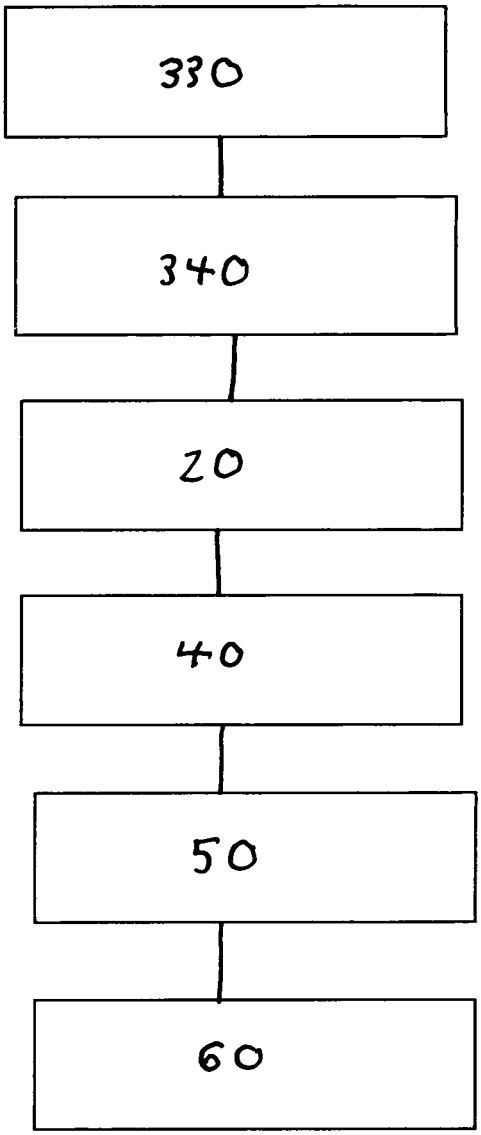
FIG. 4 illustrates an embodiment of the steps to remove moisture from a boat.

FIG. 4 illustrates another embodiment of the present invention, including the steps of:

1. Measuring the angle of the boat side with respect to a horizontal reference 330;
2. Positioning a drill fixture against the boat 340;
3. Drilling upwardly into the side of the boat at the appropriate angle to create an exposed portion 620;
4. Displacing processed air into the exposed portion 630;
5. Filling 60 the exposed portion 640 with a sealant 100.

One method to displace processed air into the exposed portion 630 is by placing a hose 120 into the exposed portion 640. The applicants processed air 610 is not ambient air. The process uses ambient at its start, and process with desiccant, to create processed air, or ultra dry air, not ambient air. Low grain moisture air. 65%-75% less moisture then ambient air, which allows that air to remove more moisture, which allows the process to be faster.

Figure 10:
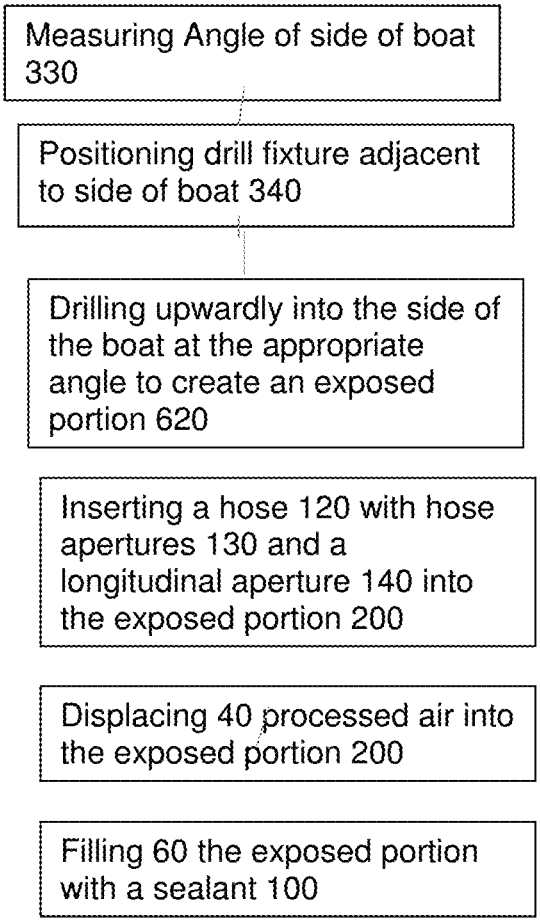
FIG. 10 illustrates FIG. 4 with the additional step of inserting a hose with hose apertures and a longitudinal aperture into the exposed portion.

FIG. 10 illustrates the additional step of inserting a hose 120 with hose apertures 130 and a longitudinal aperture 140 into the exposed portion 200.

The present invention includes the process of processing air (removing moisture) and then using that processed air 610 to dry the coring by pumping it in to the damaged area.

Figure 5:
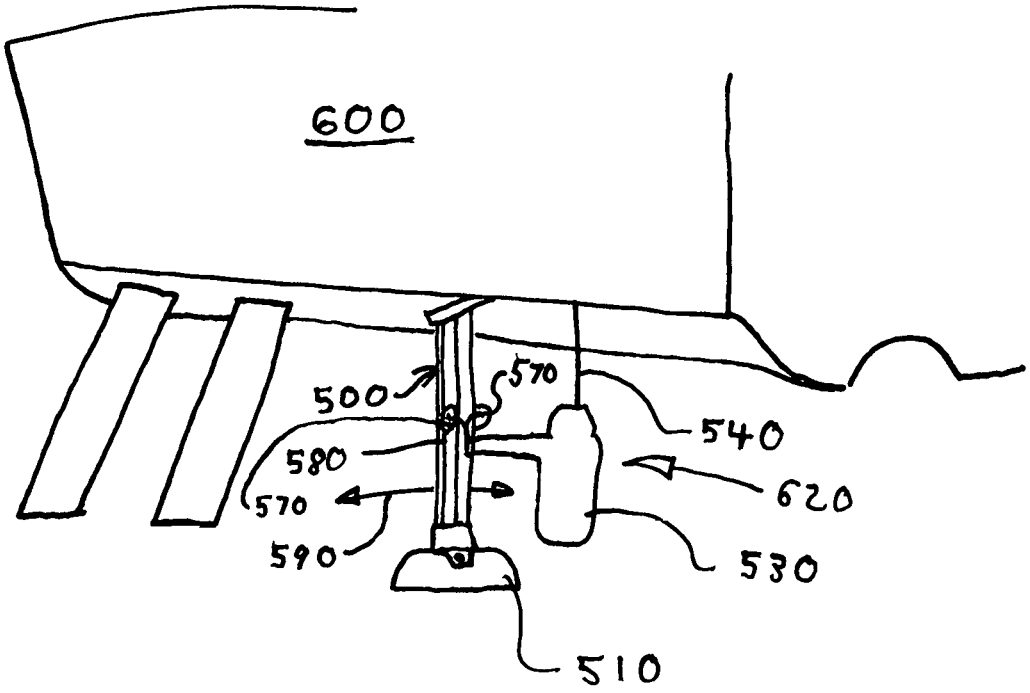
FIG. 5 illustrates an embodiment of the drill fixture and drill of the present invention.

FIG. 5 illustrates an embodiment of a drill fixture 500 of the present invention. The drill fixture 500 may be comprised of a carriage 580 that may be pivotally connected to a fixture base 510, referred to as the carriage direction of pivot 590. This way the carriage 580 may pivot to accommodate boats with different angled sides 600. A drill 530 may be allowed to travel along the carriage 580 by wheels 570.

Figure 9:
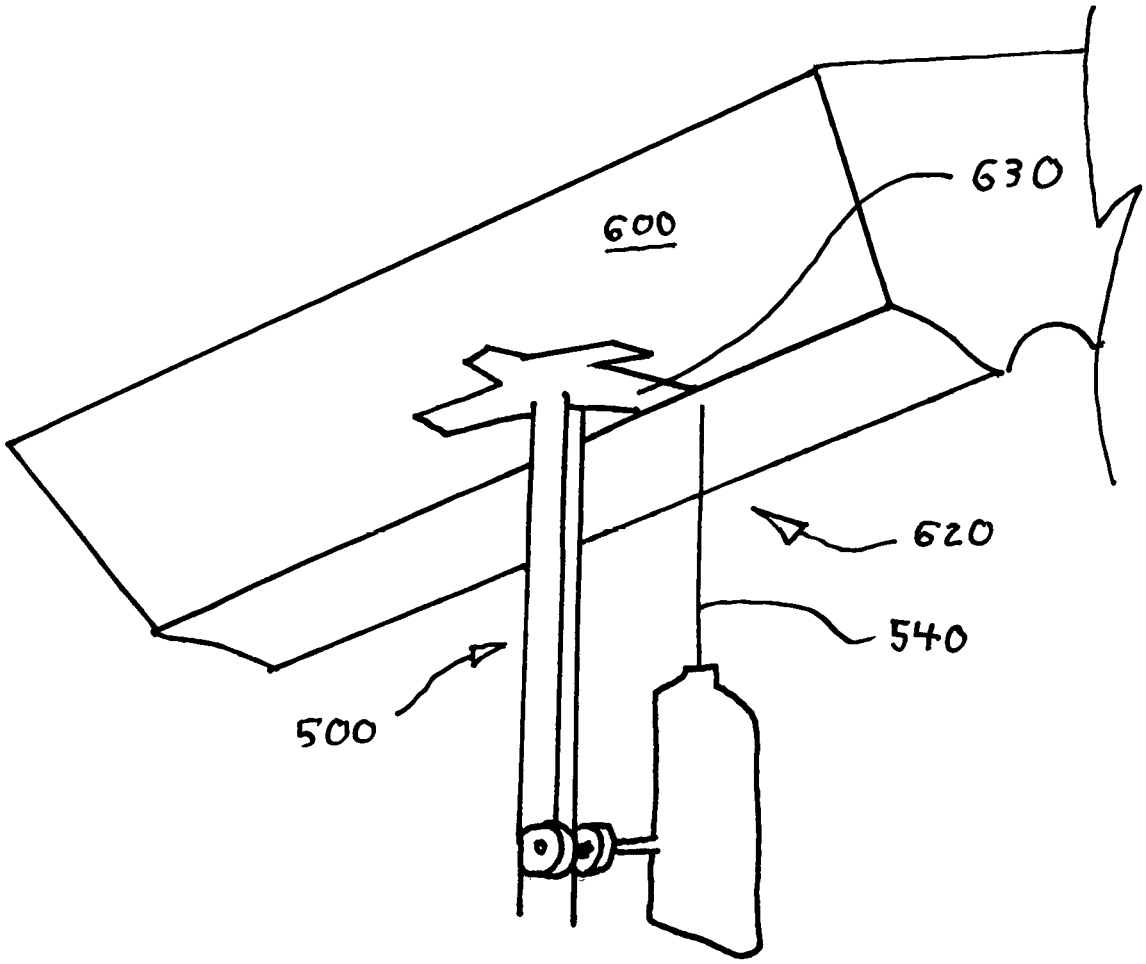
FIG. 9 illustrates the drill fixture being used on the side of the boat.

The carriage 580 may have an indented track 620 on which the wheels 570 are rollably engaged. Referring to FIG. 9, an arm 630 extends from the end of the carriage 580 opposite of the fixture base 510. This arm 630 is positioned adjacent to the boat side 600 before and during the drilling process.

When using this drill fixture 500, the drill bit 540 used may be a 3/16 diameter drill bit 540. The drill bit 540 may extend upwardly into the boat about 6 inches to 8 inches. Thus the length of the drill bit 540 should be longer than 8 inches. In some cases, the drill bit 540 may be 11 inches long.

The hose 120 can be of a diameter such that it can be disposed in the hole or bore or exposed portion 200. The hose 120 can be about ¼ inch up to about ½ inch in diameter.

A drill bit 540 is shown in the drill 530.

Figure 7:
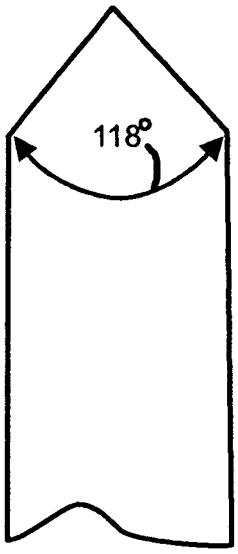
FIG. 7 Prior Art
FIG. 7 illustrates a prior art drill bit.

FIG. 7 illustrates a drill bit of the prior art with a standard 118 degrees.

Figure 8:
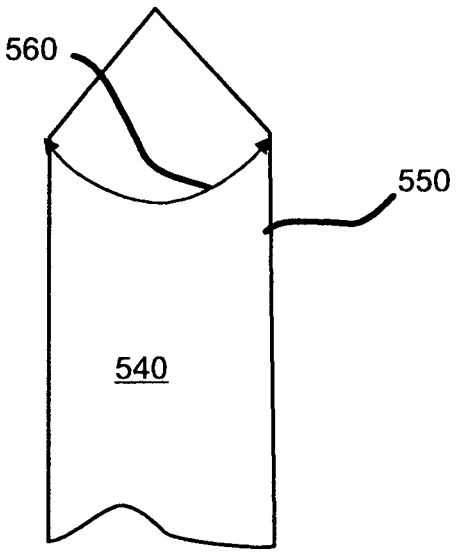
FIG. 8 illustrates a drill bit of the present invention.

FIG. 8 illustrates an embodiment of the drill bit 540 of the present invention. In one embodiment the angle of the drill bit 560 is about 59 degrees for drilling through balsa. In another embodiment the angle 560 is about 51 degrees for drilling through foam.

The drill bit 540 may have rounded off smooth cutting edge corners 550 to prevent the cutting edge of the drill bit 540 from catching and being pulled off of the desired direction during the drilling process.

The process of the present invention is faster, costs less, and more convenient to use than the prior art.

It should be understood, of course, that the foregoing relates to exemplary embodiments of the invention and that modifications may be made without departing from the spirit and scope of the invention as set forth in the following claims.

We claim:

1. A method of removing moisture from wood coring of a boat comprising the steps of:

piercing (20) a fiberglass outer skin;

forming (30) a bore or exposed portion (200) in wood coring to form (5) an exposed portion;

processing ambient air (35) by reducing moisture content present in the ambient air to create processed air; and pumping or displacing (40) said processed air into said exposed portion (200).

2. The method of claim 1, further comprising measuring the angle of a side of the boat to determine the proper orientation of a vertical bore.

3. The method of claim 2, further comprising positioning a drill fixture adjacent to the underside of the boat.

4. The method of claim 1, wherein the processed air has a relative humidity of 2%-4% and a temperature of 110 to 130 degrees.

5. The method of claim 1, the pump step includes the use of a first machine to dry said ambient air to create ultra dry air, and the use of a second machine that pumps ultra dry air into a hole.

6. A method to remove moisture from at least one of either wood or foam from a boat comprising:

measuring the angle of a side of the boat;

positioning a drill fixture under said side of the boat at a predetermined angle based on the angle of said side of the boat;

drilling upwardly into said side of the boat at the predetermined angle to create an exposed portion; processing ambient air (35) by reducing moisture content present in the ambient air to create processed air;

displacing (40) processed air into the exposed portion (200); and filling (60) the exposed portion with a sealant (100).

7. The method of claim 6, further comprising:

processing ambient air (35) by removing at least 50% of the moisture content in the ambient air to create the processed air (610);

pumping or displacing (40) said processed air (610) into bores or holes (200); and filling (60) the exposed portion (80) with a sealant (100).

8. The method of claim 7, wherein said processed air has 2%-4% relative humidity and is 110 to 130 degrees Fahrenheit when entering a hose.

9. The method of claim 6, wherein holes are 3/16 of an inch to 5/16 of an inch in diameter.

10. The method of claim 6, wherein said drill fixture (500) is positioned on the ground under said side of the boat, the arm (630) of the drill fixture is positioned adjacent to the boat side (600), and a carriage on the drill fixture is pivotally connected to a base.

11. The method of claim 6, further comprising a drill bit (540) having a rounded cutting edge corner (550) that defines the diameter of the desired hole.

12. The method of claim 6, further comprising the step of:

selecting a hose with the same diameter as the exposed portion; and inserting said hose with hose apertures and a longitudinal aperture into the exposed portion.

13. The method of claim 6, wherein the processing of ambient air step (35) uses a desiccant to reduce the moisture in the processed air (610) by 60% to 70% before it is displaced into said exposed portion.

* * * * *